US006390713B1

(12) United States Patent
Moor et al.

(10) Patent No.: US 6,390,713 B1
(45) Date of Patent: May 21, 2002

(54) ADAPTER FOR A COIL BOUND NOTEBOOK

(75) Inventors: Marc L. Moor, Oakwood; Kate M. O'Hara, Dayton; Bobby G. James, Jr., Miamisburg, all of OH (US); Thomas DeBlasis, Pittsburgh, PA (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/711,581

(22) Filed: Nov. 13, 2000

(51) Int. Cl.[7] ..... B42F 13/04

(52) U.S. Cl. ..... 402/57; 402/79; 281/21.1; 281/15.1

(58) Field of Search ..... 402/79, 80 K, 402/57; 281/15.1, 21.1, 38, 27.2, 27.3, 28, 45, 50, 51

(56) References Cited

U.S. PATENT DOCUMENTS

| | | | | |
|---|---|---|---|---|
| 717,957 | A | 1/1903 | Weaver | |
| 792,747 | A | 5/1905 | Anderson et al. | |
| 818,130 | A | 4/1906 | Swan | |
| 852,871 | A | 5/1907 | Cohn | |
| 868,758 | A | 10/1907 | Bexell | |
| 1,107,351 | A | 8/1914 | Proudfit | |
| 1,156,160 | A | 10/1915 | Lewis | |
| 1,371,459 | A | 3/1921 | Amlie | |
| 2,093,041 | A | 9/1937 | Emery | 129/1 |
| 2,153,575 | A | 4/1939 | Kramer | |
| 2,681,655 | A | 6/1954 | Schade | 129/1 |
| 2,848,163 | A | 8/1958 | Van Horne Serrell | |
| 2,904,900 | A | 9/1959 | Kramer | 35/55 |
| 4,193,704 | A | 3/1980 | Miller et al. | 402/19 |
| 4,430,015 | A | 2/1984 | Nerlinger | 402/79 |
| 4,551,039 | A | 11/1985 | Basseches | |
| 4,636,179 | A | 1/1987 | Gentile et al. | |
| 4,645,237 | A | 2/1987 | Squire et al. | 281/47 |
| 4,699,538 | A | * 10/1987 | Caine | 402/79 |
| 4,940,353 | A | 7/1990 | Osono et al. | |
| 5,015,114 | A | 5/1991 | Miller | |
| 5,033,899 | A | 7/1991 | Pitts et al. | 402/80 R |
| D319,260 | S | 8/1991 | Dubaj | D19/32 |
| 5,066,046 | A | 11/1991 | Hoopingarner | |
| D325,928 | S | 5/1992 | Bourgeois | D19/27 |
| 5,234,277 | A | 8/1993 | Le | |
| 5,405,169 | A | 4/1995 | Schwartz | |
| 5,433,480 | A | 7/1995 | Gresham et al. | 281/17 |

(List continued on next page.)

OTHER PUBLICATIONS

Attachment A, European sample with three snap–in tabs and divider tabs; date unknow; admitted to be prior art for the limited purpose of consideration of this reference as prior art in the prosecution of this application; applicant reserves the right to challenge the status of this reference as prior art.

Attachment B, bound–in kraft paper pocket dividers; date unknown; admitted to be prior art for the limited purpose of consideration of this reference as prior art in the prosecution of this application; applicant reserves the right to challenge the status of this reference as prior art.

Attachment C, Snap–in planner ruler from DayRunner; date unknown; admitted to be prior art for the limited purpose of consideration of this reference as prior art in the prosecution of this application; applicant reserves the right to challenge the status of this reference as prior art.

*Primary Examiner*—Willmon Fridie, Jr.
(74) *Attorney, Agent, or Firm*—Thompson Hine LLP

(57) ABSTRACT

An adapter for coupling a piece of paper having a plurality of holes to a binding coil, the adapter comprising a strip of material having a plurality of attachment components. Each attachment component is shaped to be passed through one of the plurality of holes of the paper to couple the paper to the strip. The strip of material further has a quick attachment feature for releasably coupling the strip to the coil.

12 Claims, 7 Drawing Sheets

U.S. PATENT DOCUMENTS

| | | | | |
|---|---|---|---|---|
| 5,433,546 | A | 7/1995 | Kershaw | |
| 5,476,336 | A | 12/1995 | Osiecki et al. | 402/79 |
| 5,480,192 | A | 1/1996 | Angerbauer et al. | 281/31 |
| 5,489,120 | A | 2/1996 | Thornsburg | |
| 5,524,998 | A | 6/1996 | Schwartz | 402/79 |
| D375,758 | S | 11/1996 | Osiecki et al. | D19/32 |
| 5,572,815 | A | 11/1996 | Kovner | |
| 5,590,972 | A | 1/1997 | Shobin | 402/79 |
| 5,597,256 | A | 1/1997 | Burton et al. | |
| D384,102 | S | 9/1997 | Osiecki et al. | D19/32 |
| 5,669,726 | A | 9/1997 | Karlis et al. | 402/4 |
| 5,695,294 | A | 12/1997 | Bedol et al. | 402/79 |
| 5,704,724 | A | 1/1998 | Karlis et al. | 402/79 |
| 5,709,496 | A | 1/1998 | Werner et al. | |
| 5,727,894 | A | 3/1998 | Covey | |
| D393,483 | S | 4/1998 | Covey | D19/32 |
| 5,771,598 | A | 6/1998 | Lassberg | 33/494 |
| 5,806,677 | A | 9/1998 | Storti | |
| 5,836,711 | A | 11/1998 | Stewart | 402/79 |
| D404,424 | S | 1/1999 | Covey | D19/32 |
| 5,887,900 | A | 3/1999 | Raymond | 281/22 |
| 5,909,979 | A | 6/1999 | Winzen | |
| 5,915,873 | A | 6/1999 | Karlis | 402/79 |
| 5,924,736 | A | 7/1999 | Russo | 281/38 |
| D427,632 | S | 7/2000 | McNeil | D19/33 |
| 6,082,612 | A | 7/2000 | Black | |
| 6,086,281 | A | 7/2000 | Covey | |
| 6,135,662 | A | 10/2000 | Bakke et al. | |
| 6,193,065 | B1 | 2/2001 | Salomone | |
| 6,249,390 | B1 | 6/2001 | Thibodeaux, Jr. | |

* cited by examiner

ADAPTER FOR A COIL BOUND NOTEBOOK

The present invention is directed to an adapter for a coil bound notebook, and more particularly, to an adapter that can receive loose leaf papers and couple the papers to a coil bound notebook.

BACKGROUND OF THE INVENTION

Coil bound notebooks are often used by students, professionals and other users to provide paper and writing surfaces for notes, homework assignments, sketches and the like. The papers bound in the notebooks may be used as part of the notebook, or removed for standalone use. The notebook may also include a plurality of tab dividers, pockets, pouches, or other organizational features for receiving loose papers or other items, and typically include a wire or plastic coil that binds the papers, covers, pockets, dividers, and other components of the notebook together. In this manner, a coil bound notebook is a versatile, flexible tool which can serve as an organizer, storage device, paper dispenser and writing tablet.

In a typical coil bound notebook, the various components are permanently bound together by the binding coil. The notebook provides an efficient paper source, and papers are removed from the coil binding component throughout the life of the notebook. However, with most existing coil bound notebook, once the papers are removed from the coil binding component, the useful life of the notebook is exhausted, as there is no easy, effective way to add paper to the coil binding mechanism. Accordingly, there is a need for a adapter that can quickly and easily couple loose leaf paper to the binding coil of a coil bound notebook.

SUMMARY OF THE INVENTION

The present invention is an adapter that can quickly and easily couple loose leaf papers to the binding coil of a coil bound notebook. In one embodiment, the invention is an adapter for coupling a piece of paper having a plurality of holes to a binding coil, the adapter comprising a strip of material having a plurality of attachment components. Each attachment component is shaped to be passed through one of the plurality of holes of the paper to couple the paper to the strip. The strip of material further has a quick attachment feature for releasably coupling the strip to the coil.

Other objects and advantages of the present invention will be apparent from the following description and the accompanying drawings.

DETAILED DESCRIPTION

Figure 1:
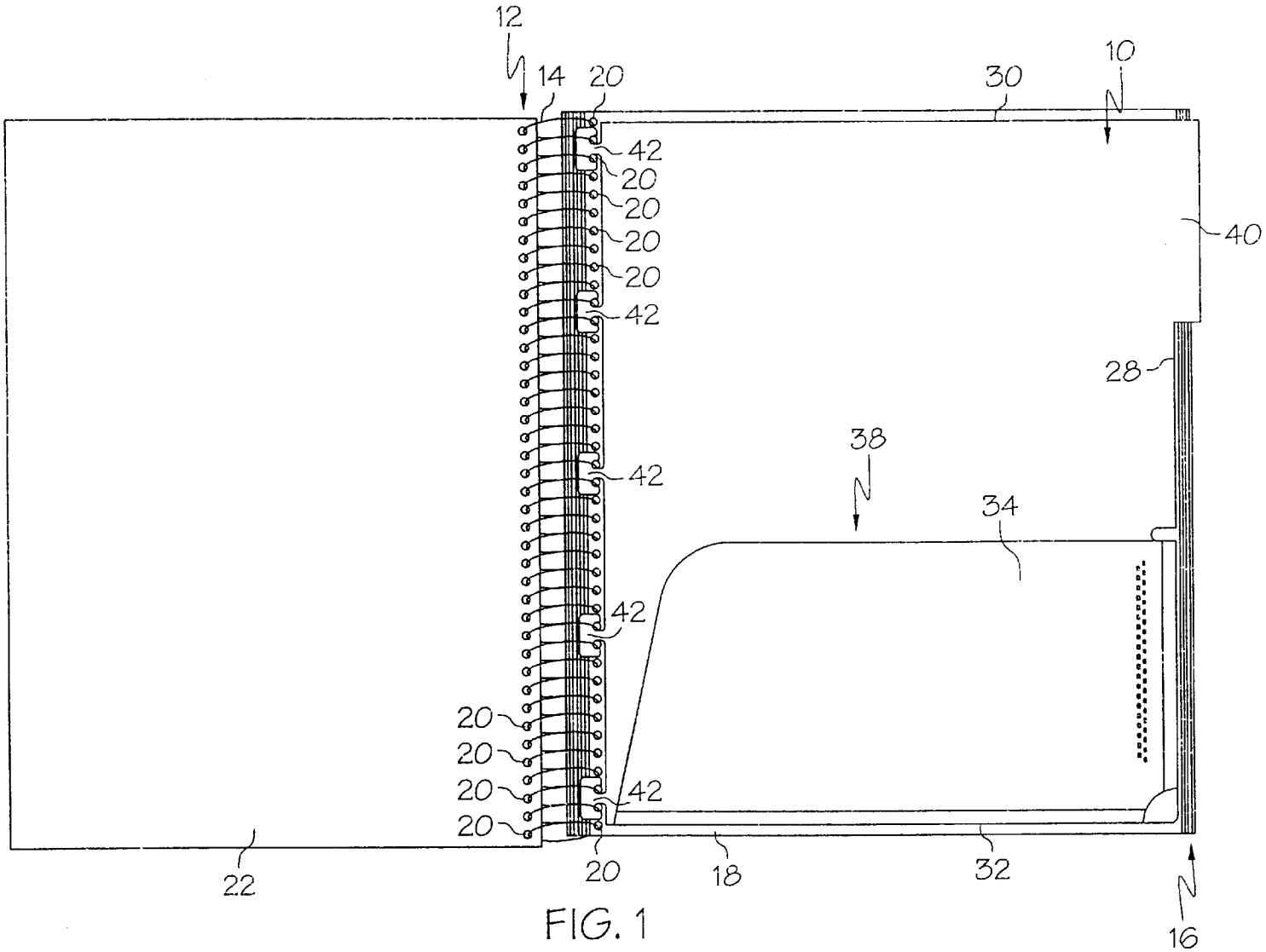
FIG. 1 is a top view of a notebook with a notebook insert received therein.

As shown in FIG. 1, an insert or tab divider, generally designated 10, is shaped to be received in a notebook 12 having a coil 14 or other similar coil binding mechanism. The notebook 12 includes a plurality of papers 16, each paper having a plurality of binding holes 20 formed therein. For example, top paper 18 includes a plurality of binding holes 20 visible in FIGS. 1 and 4. Each binding hole 20 receives a turn of the coil 14 to bind the papers 16, 18 to the coil. The notebook preferably has a front cover 22 and a rear cover (not shown), as well as other pockets, dividers and other components (not shown) spaced throughout the thickness of the notebook 12. Each of the components typically includes a plurality of binding holes 20 to bind the component to the coil 14.

Figure 2:
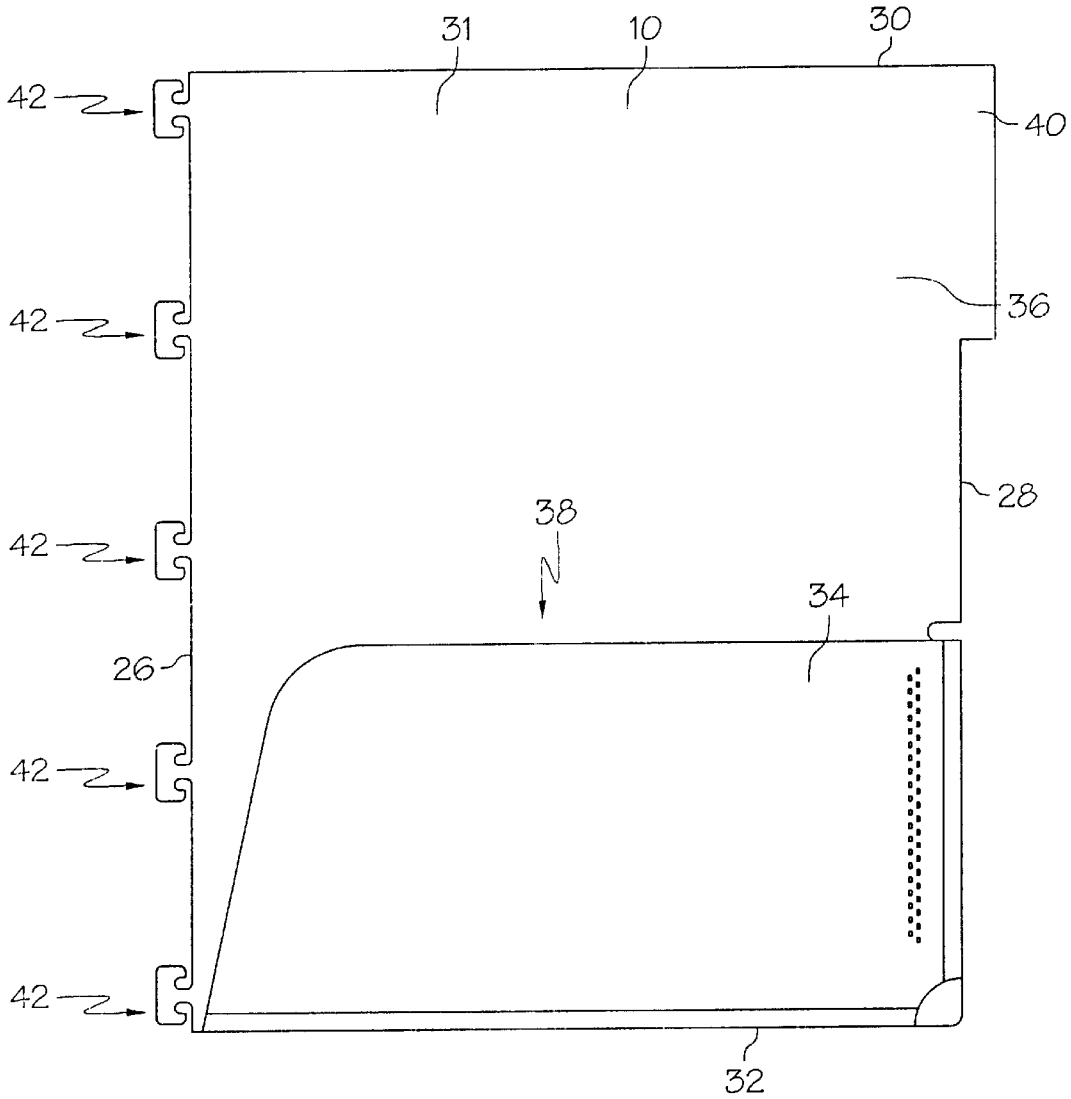
FIG. 2 is a front view of the insert of FIG. 1.
Figure 3:
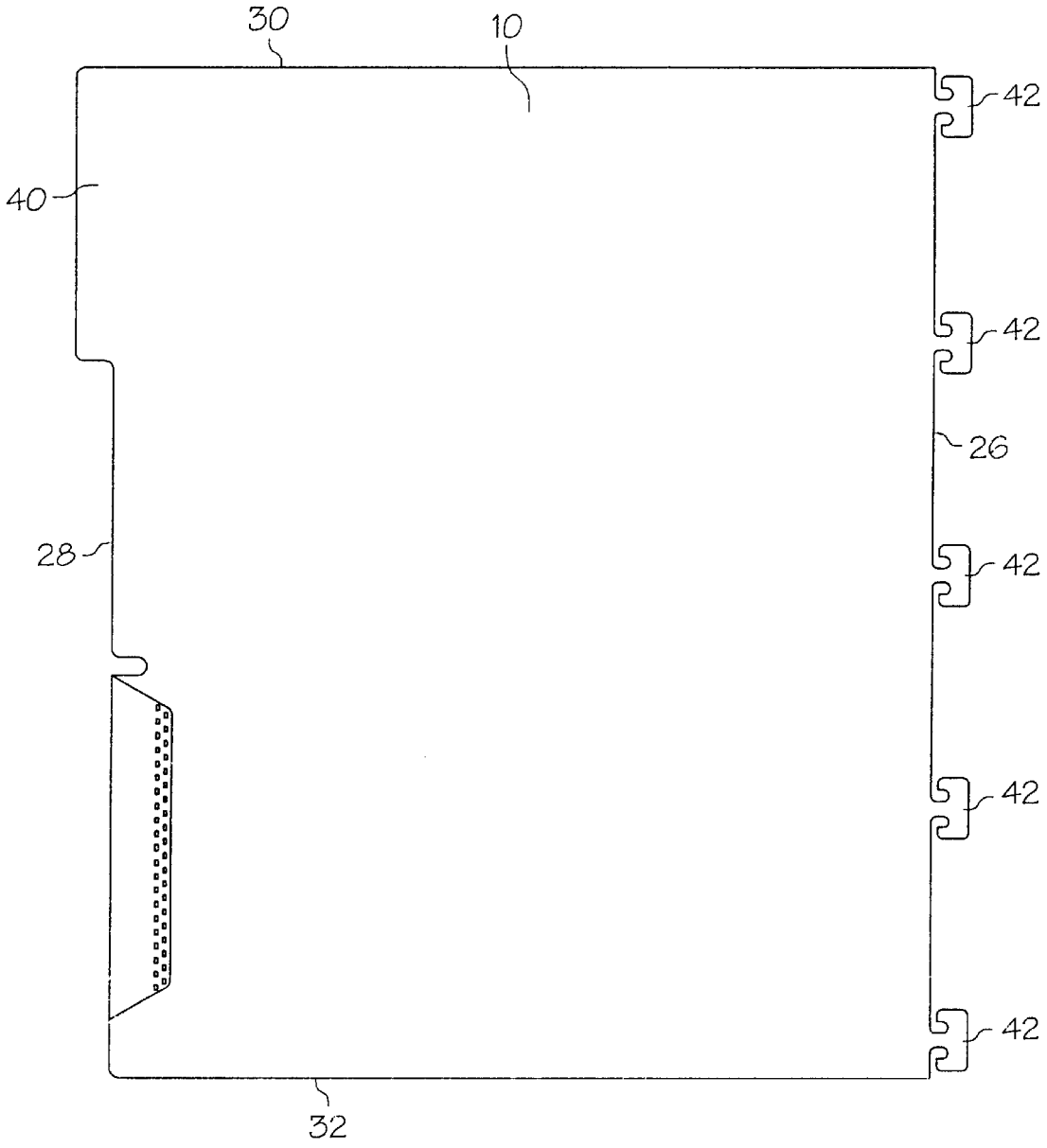
FIG. 3 is a back view of the insert of FIG. 2.

As best shown in FIGS. 2–3, the tab divider 10 includes inner 26, outer 28, top 30 and bottom 32 edges, and is preferably made of cardboard, plastics, polypropylene, or other materials. The tab divider 10 preferably includes a lower panel 34 attached to its front face 31. The lower panel 34 and main panel 36 form a pocket 38 therebetween for receiving papers and other loose items. The tab divider 10 may also include a tab portion 40 extending outwardly from the outer edge 28 to serve as a locator/identifier. The tab portion 40 can be located at various locations along the length of the outer edge 28, as desired, to form a tab locator system with other tab dividers.

Figure 4:
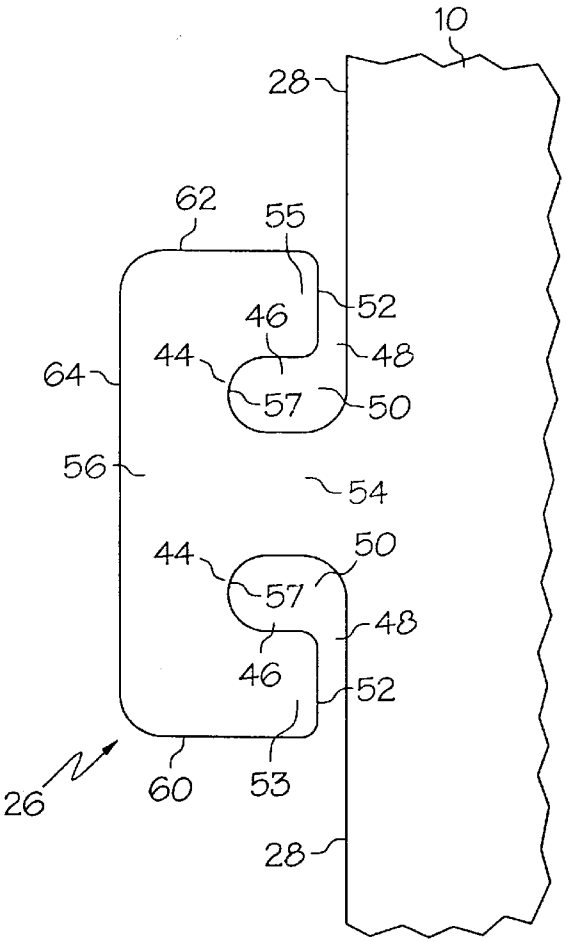
FIG. 4 is a detail view of a wing of the insert of FIG. 2.

The tab divider 10 includes a plurality of wings 42 extending generally outwardly from the inner edge 26 of the tab divider. As shown in FIG. 4, wing 26 is generally rectangular in top view, and includes a pair of coil receiving portions 44, each coil receiving portion 44 having a coil receiving opening 46 formed therein. Each coil receiving opening 46 has a throat portion 48 and an inner portion 50. Each inner portion 50 is generally circular in top view and is shaped and located to receive the turn of a coil 14 therein to couple the tab divider 10 to the coil 14. The diameter of each inner portion 50 is preferably smaller than the diameter of the binding holes 20 of any adjacent components that increase the surface area and strength of a wing.

Each throat portion 48 is shaped and located to enable a turn of the coil 14 to be passed therethrough and be received in the associated inner portion 50. Each throat portion 48 extends generally parallel to the inner edge 52 of the tab wing 26 and the inner edge 28 of the tab divider 10. Each throat portion 48 is preferably a "channel" defined by a narrow opening between the inner edge 52 of the wing 26 and the inner edge 28 of the tab divider 10. However, the throat portion 48 may simply be a slit cut in the divider (i.e. in this case the inner edges 52, 28 are immediately adjacent or in contact). When the throat portion 48 is a slit, it is simply a cut in the material of the divider 10, and no material is removed. However, in this case the edges of the slit throat portion may be deformed when the turns of a coil are passed through the throat portion 48, which can be unsightly and may catch papers thereon. Accordingly, the illustrated "channel" throat portion 48 is preferred.

Each wing 26 includes a central stem 54 that extends generally outwardly from the inner edge 28 of the tab divider 10, and a crown portion 56 that extends generally transverse to the central stem 50. The crown portion 56 includes a pair of indentations 57, which define the inner portions 50 of the coil receiving openings 46, each indentation 57 being located on opposed sides of the stem 54. Each wing includes a pair of tip portions 53, 55 that extend from the crown portion 56 toward the inner edge 26 of the tab divider 10.

The tip portions 53, 55 define the coil receiving portions 44 located between the tip portions 53, 55 and the central stem 54. The tip portions 53, 55 help to maintain a turn of the coil 14 in the associated coil receiving openings 46.

The wing 26 includes an inner edge 52 that extends generally parallel to the inner edge 28 of the tab divider 10, a pair of side edges 60, 62 that extend generally perpendicular to the inner edge 28, and an outer edge 64 that extends generally parallel to the inner edges 52 of the wing. The wing 26 includes rounded corners at the intersections of the side edges 60, 62 and the inner 52 and outer 64 edges of the wing to prevent the wings from "catching" on the coil 14 or papers 16. The indentations 57 and coil receiving openings 46 are also preferably defined by curved edges to reduce interference between the wings 26 and the coil 14 and papers 16.

In order to couple the tab divider 10 to the coil 14, the wing 26 is deflected such that a turn of the coil 14 (i.e., turn 68, of FIG. 5) is passed through the throat portion 48 and received in the associated inner portion 50 of the associated coil receiving opening 46. Similarly, the other 206 end of the wing 26 is then deflected such that turn 70 is received through the associated throat portion 48 and received in the associated inner portion 50 of the associated coil receiving opening 46. The same procedure is repeated for the remaining wings 26 to attach the tab divider 10 to the coil 14. The sequence of operations is reversed to decouple the tab divider 10 from the coil.

It should be understood that by the term "turn" of a coil, it is meant any length of the coil which is received through a binding hole 20 of a paper 16, 18 or coil receiving opening 46 of a wing 20. For example, in some coils, each turn may be comprised of two or more parallel, closely spaced wires or turns.

The throat portion 48 of each coil receiving opening 46 is preferably wide enough to allow easy insertion and removal of at least one turn of the coil 14, but is small enough to not compromise the strength of each wing 26. The number of wings 26 may be increased or decreased as desired, although it has been found that five wings as shown in FIGS. 1–3 is preferred for use with a standard size notebook.

Figure 5:
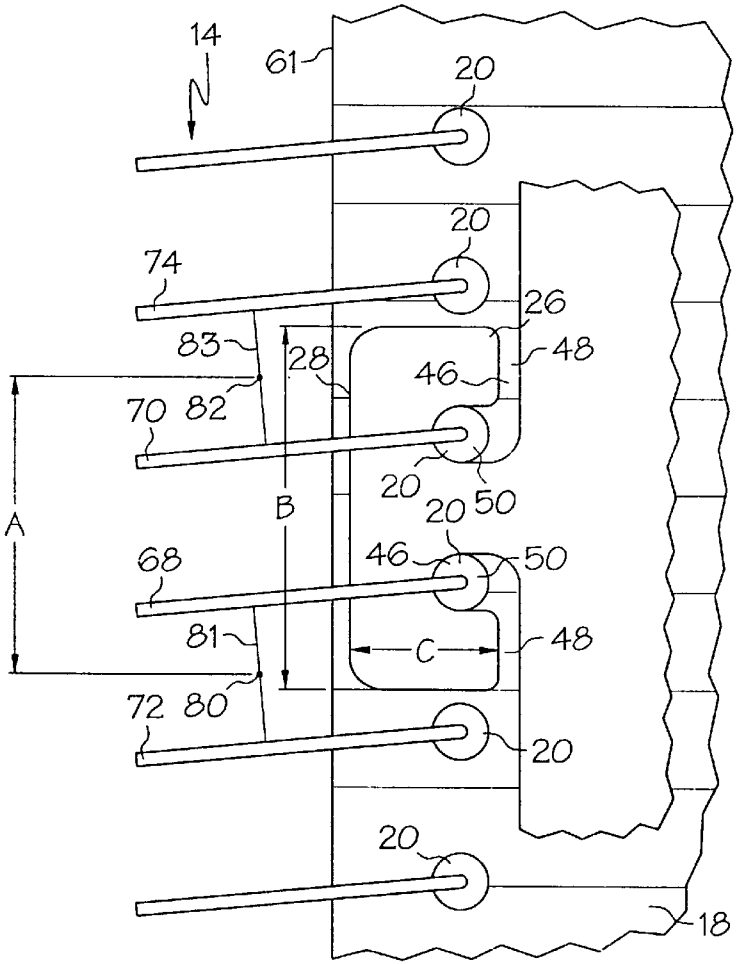
FIG. 5 is a detail view of the wing of FIG. 4 mounted to the coil of a coil bound notebook.

As shown in FIG. 5, two (preferably adjacent) turns 68, 70 of the coil 14 are received in each wing 26. A distance A extends between the mid-point 80 of adjacent turns 68 and 72 and the mid-point 82 of adjacent turns 70 and 74. By the term "midpoint" it is meant the midpoint of an imaginary line 81 drawn between the turns 68, 72 and perpendicular to the turns 68, 72, and the midpoint of an imaginary line 83 drawn between the turns 70, 74 and perpendicular to the turns 70, 74. The length B of each wing 26 is preferably greater than the distance A, but of course shorter than the distance between turns 72 and 74. This length B of the wing 20 provides a large surface area and strength to the wing 26, and helps prevent the wing from being pulled out from the coil 14 when external forces are applied to the tab divider 10. Furthermore, because the length B is shorter than the distance between turns 72 and 74, the wing does not interfere with the papers or other components of the notebook.

The width C of the tab divider 26 is preferably selected such that the inner edge 28 of the tab divider 26 does not extend beyond the inner edge 61 of any adjacent papers 16, 18. This ensures that the wings 26 do not interfere with the pages of the notebook 12 when the pages are turned in the notebook. Furthermore, as noted earlier, all corners of the wing 26 are preferably rounded off to prevent any sharp corners from interfering with the papers 16, 18 or coil 14, or from scratching the fingers of the user.

The wing connector system can be utilized with nearly any component which is desired to be coupled to a notebook, including but not limited to rulers, pouches, dividers, pockets, protective covers, school supplies, other notebooks, papers, writing instruments, electronic devices, planners, reference cards and the like. The wing connector system enables the component, or insert, to be coupled to the notebook at any location through the thickness of the notebook. Thus, a user can move components having the wing connector system of the present invention to customize the notebook. Furthermore, components such as calculators, pouches, electronic devices, pockets and the like having the wing connector system of the present invention can be releasably coupled to the coil bound notebook such that the components can be used in a standalone mode, and then reattached to a coil bound notebook for storage.

Figure 6:
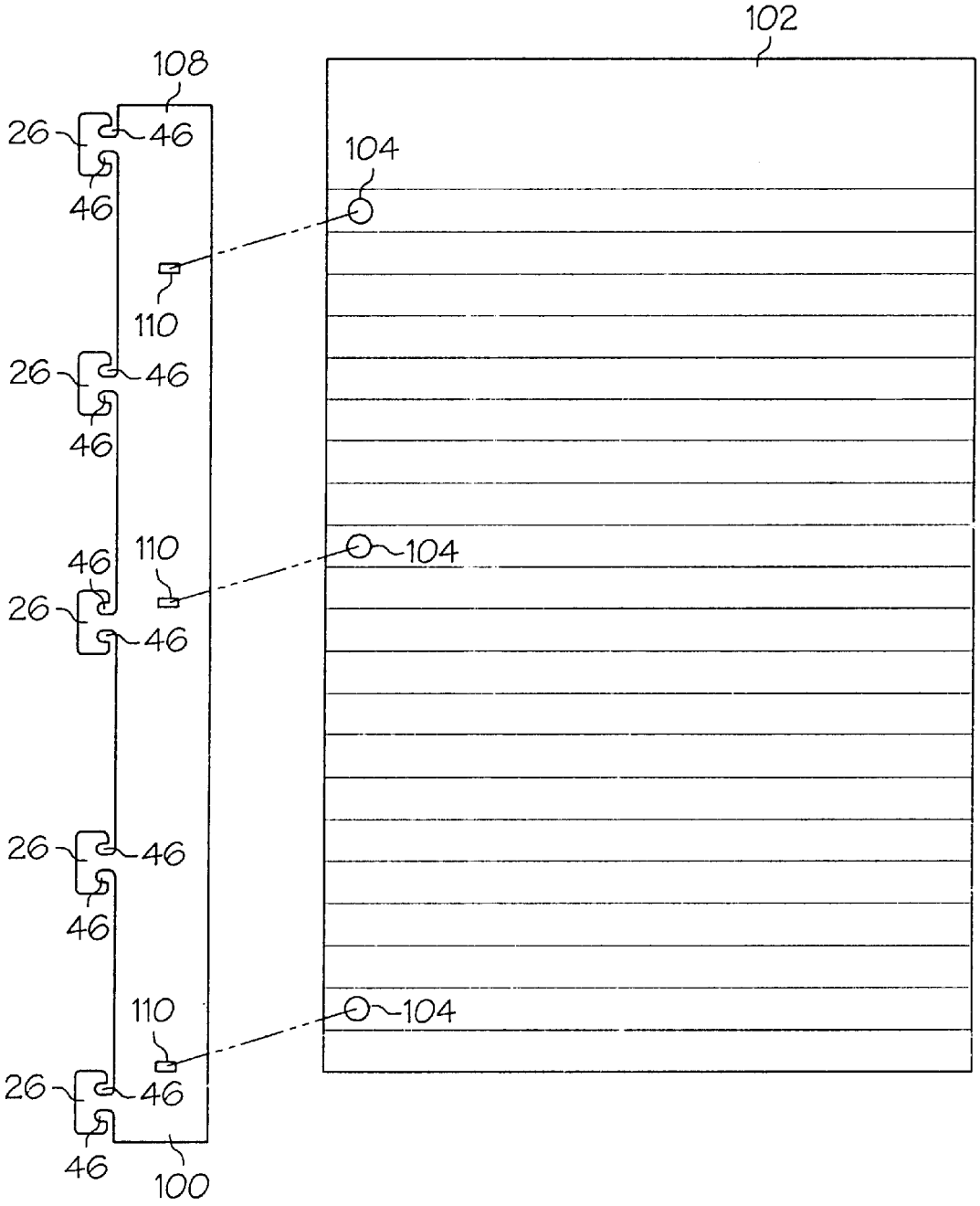
FIG. 6 is a top view of one embodiment of an adapter of the present invention.
Figure 7:
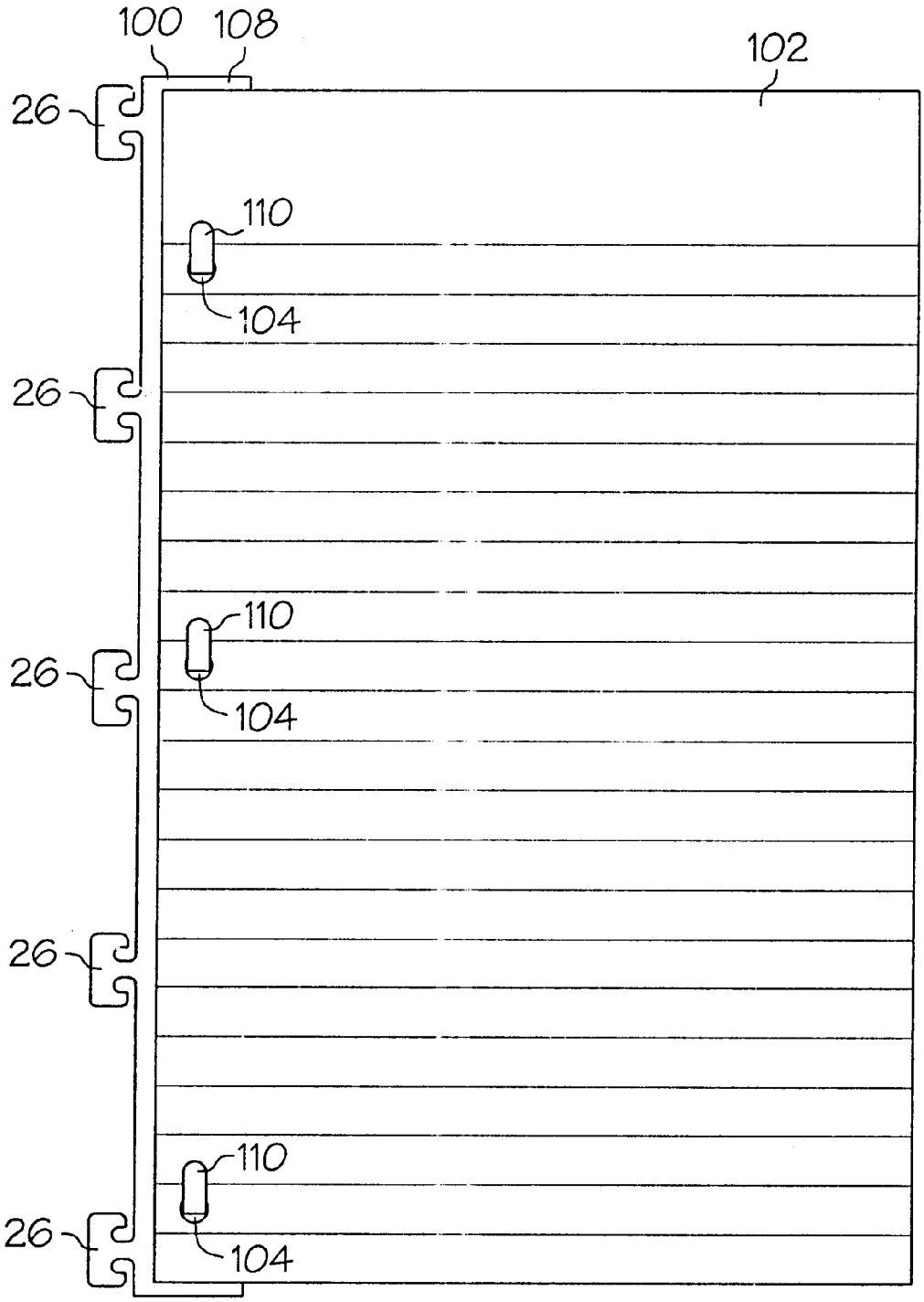
FIG. 7 is a top view of the adapter of FIG. 6 receiving a piece of paper therein.

One embodiment of the adapter 100 of the present invention is shown in FIG. 6. The adapter 100 includes the quick attach feature of the wing connectors 26 for attaching the adapter to a coil bound notebook. The adapter 100 is shaped to receive a loose leaf paper 102 or papers having a plurality of holes 104 formed therein. The holes 104 are typically located such that the paper 102 can be coupled to a three ring binder. The adapter 100 includes a strip of material 108 having a plurality of pliable prong components 110, each prong component being shaped and located to fit through an associated hole 104 in the paper 102, and deflected to couple the paper 102 to the adapter (see FIG. 7).

In order to couple a paper 102 or plurality of papers to the coil, the pliable prong components 110 are first folded to their upright position (FIG. 6), passed through a hole 104 of the paper 102, and then deflected such that each prong component lays flat over the top surface of the paper (FIG. 7) in a well known manner. The adapter 100 can then be coupled to the coil 14 in the same manner discussed above by fitting the wings 26 between adjacent turns of the coil such that each coil receiving opening 46 receives a turn therein. Of course, the sequence of operations may be reversed such that the adapter 100 is first coupled to the coil 144, and the paper(s) then coupled to the adapter.

Figure 8:
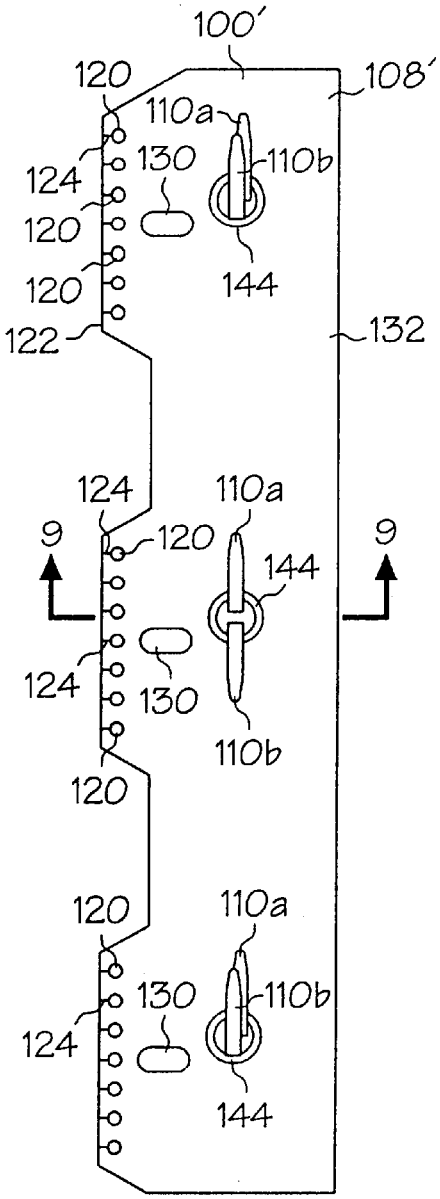
FIG. 8 is a top view of an alternate embodiment of the adapter of FIG. 6.

The adapter may include a variety of other quick-attach features for coupling the adapter to a coil beyond the quick-attach wing portions discussed above. For example, FIG. 8 illustrates an alternate embodiment of the adapter as adapter 100'. The adapter 100' may include a plurality of openings 120 located adjacent an inner edge 122 of the strip of material 108', each opening 120 being shaped and located to receive at least one turn of a coil. The adapter 100' includes a plurality of slits 124, with each slit extending from the inner edge 122 of the adapter 100' to one of the openings 120 to enable a turn of a coil to be removably slid into, and received in, the associated opening 120. In this embodiment, each opening 120 is generally circular, and each slit 124 is a cut formed in the strip 108', although the slits 124 may also be a small strip of material removed from the strip 108' similar to the throat portion 48 of the wing connector system. The adapter 100' shown in FIG. 8 also includes a plurality of openings 130 extending through the adapter 100' for receiving the rings of a binder, such as three-ring binder, therethrough to couple the adapter to the binder. Furthermore, the adapter 100' may include a pair of prong components 110*a*, 110*b* that can be splayed in opposite directions to couple a paper 102 to the adapter 100'.

Figure 9:
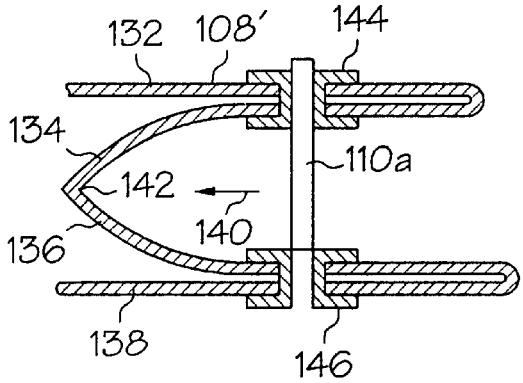
FIG. 9 is a side cross section taken along line 9—9 of FIG. 8.

As shown in FIG. 9, the adapter 100' may be a piece of material 108' folded over itself to form an upper, or first layer 132, a second layer 134, a third layer 136, and a bottom or fourth layer 138. The second layer 134 and third layer 136 form a V-shape having an opening 140 therebetween. A paper 102 can be received in the opening 140 such that the inner edge of the paper 102 is received in crease 142 and the prong components 110*a* and 110*b* passed through the holes 104 of a paper 102. The upper 132 and second 134 layers are connected by a rivet 144 having a central opening therein, and the third 136 and bottom 138 layer are connected by a rivet 146. The prong component 110*a*, 110*b* are coupled to the rivet 146, and extend through the central opening in rivet 144 such that they can be folded over the top layer 132.

In this manner, the adapter provides a mechanism for adding additional sheets to a coil bound notebook. In many prior art coil bound notebooks, once the originally bound papers of the coil bound mechanism are used and/or removed, the binder must discarded. The adapter provides a mechanism for adding additional paper to the coil bound notebook, thereby extending the useful life of a coil bound notebook.

Having described the invention in detail and by reference to the preferred embodiments, it will be apparent that modifications and variations thereof are possible without departing from the scope of the invention.

What is claimed is:

1. An adapter for coupling a piece of paper having a plurality of holes to a binding coil, the adapter comprising a strip of material having a plurality of attachment components, each attachment component being shaped to be passed through one of said plurality of holes of said paper to couple said paper to said strip, said strip further having a quick attachment feature for releasably coupling said strip to said coil wherein said quick attachment feature includes a plurality of wings, each wing having a central stem extending outwardly from an inner edge of said strip of material and a coil receiving portion located on either side of said stem, each coil receiving portion being shaped and located to receive a turn of said binding coil therein to couple said insert to said binding coil.

2. The adapter of claim 1 wherein each attachment component includes a pliable prong that is shaped to fit through an associated hole of said paper and is deflectable over a top surface of said paper to couple said paper to said adapter.

3. The adapter of claim 1 wherein each wing includes a pair of tip portions extending inwardly toward the inner edge, each tip portion being located adjacent an associated coil receiving portion.

4. The adapter of claim 1 wherein each wing includes a crown portion that extends generally transverse to said central stem, and wherein each coil receiving portion includes an indentation formed in said crown portion.

5. The adapter of claim 4 wherein each indentation is defined by a generally curved edge.

6. The adapter of claim 1 wherein each wing has a length that is less than the distance between: a) a first turn of said coil that is located adjacent to a turn received in one of said coil receiving portions and b) a second turn of said coil that is located adjacent to a coil received in the other of said coil receiving portions.

7. The adapter of claim 1 wherein each coil receiving portion including a coil receiving opening located between said wing and said inner edge, each coil receiving opening having a throat portion and an inner portion, each inner portion being shaped and located to receive a turn of a coil therein to couple said insert to said coil, each throat portion being shaped and located to allow a turn of said coil to be passed therethrough to be received in an associated inner portion.

8. An adapter for coupling a piece of paper having a plurality of holes to a binding coil, the adapter comprising a strip of material having a plurality of attachment components, each attachment component being shaped to be passed through one of said plurality of holes of said paper to couple said paper to said strip, said strip further having a quick attachment feature for releasably coupling said strip to said coil, wherein said quick attachment feature includes a plurality of openings located adjacent an inner edge of said strip, each opening being shaped and located to receive a turn of said binding coil, said adapter further including a plurality of slits, each slit extending from said inner edge to one of said openings to enable a turn of said binding coil to be received in each opening.

9. The adapter of claim 8 wherein each opening is generally circular and each slit is a cut formed in said strip.

10. An adapter for coupling a piece of paper having a plurality of holes to a binding coil, the adapter comprising a strip of material having a plurality of pliable prong components, each prong component being shaped and located to be received through one of said plurality of holes of said paper and deflected over said paper to couple said paper to said strip, said strip further having a plurality of openings, each opening being shaped and located to receive a turn of said coil therein to couple said adapter to said binding coil, said strip including an inner edge and a plurality of access slots, each, slot extending from one of said openings to said inner edge.

11. A notebook comprising:

a plurality of papers;

a coil binding mechanism that binds said plurality of papers together; and an adapter for coupling an auxiliary piece of paper having a plurality of holes to said coil binding mechanism, the adapter comprising a strip of material having a plurality of pliable prong components, each prong component being shaped and located to be received through one of said plurality of holes of said auxiliary piece of paper and deflected over a top surface of said auxiliary paper to couple said auxiliary paper to said strip, said strip further having a plurality of openings, each opening being shaped and located to receive a turn of said coil therein to couple said adapter to said coil.

12. An adapter for coupling a piece of paper having a plurality of holes to a binding coil, the adapter comprising a strip of material having a plurality of attachment components, each attachment component being shaped to be passed through one of said plurality of holes of said paper to couple said paper to said strip, said strip further having a quick attachment feature for releasably coupling said strip to said coil wherein said quick attachment feature includes a plurality of wings, each wing having a central stem extending outwardly from an inner edge of said strip of material and at least one coil receiving portion located adjacent to said stem, said coil receiving portion being shaped and located to receive a turn of said binding coil therein to couple said insert to said binding coil.

* * * * *